US007994739B2

(12) United States Patent
Chen

(10) Patent No.: US 7,994,739 B2
(45) **Date of Patent: *Aug. 9, 2011**

(54) INTERNAL INJECTION BETATRON

(75) Inventor: Felix K. Chen, Newtown, CT (US)

(73) Assignee: Schlumberger Technology Corporation, Cambridge, MA (US)

( * ) Notice: Subject to any disclaimer, the term of this patent is extended or adjusted under 35 U.S.C. 154(b) by 247 days.

This patent is subject to a terminal disclaimer.

(21) Appl. No.: 12/334,495

(22) Filed: Dec. 14, 2008

(65) Prior Publication Data

US 2010/0150312 A1 Jun. 17, 2010

(51) Int. Cl.

| | |
|---|---|
| ***H05H 11/00*** | (2006.01) |
| ***H01F 7/00*** | (2006.01) |
| ***H01F 7/08*** | (2006.01) |
| ***H01J 35/00*** | (2006.01) |

(52) U.S. Cl. ... 315/504; 315/507; 315/500; 315/111.61; 335/210; 335/296; 250/298; 250/396 R

(58) Field of Classification Search ..... 315/504, 315/507, 500, 111.61; 250/298, 396 R; 335/210, 335/296

See application file for complete search history.

(56) References Cited

U.S. PATENT DOCUMENTS

| | | | | |
|---|---|---|---|---|
| 5,122,662 | A | 6/1992 | Chen et al. | |
| 7,638,957 | B2 * | 12/2009 | Chen | 315/504 |
| 2010/0148705 | A1 * | 6/2010 | Chen | 315/507 |

* cited by examiner

*Primary Examiner* — Nikita Wells

(74) *Attorney, Agent, or Firm* — Brigid Laffey; Helene Raybaud

(57) ABSTRACT

A betatron magnet having at least one electron injector positioned approximate an inside of a radius of a betatron orbit, the betatron magnet further includes a first guide magnet having a first pole face and a second guide magnet having a second pole face. Both the first and the second guide magnet have a centrally disposed aperture and the first pole face is separated from the second pole face by a guide magnet gap. A core is disposed within the centrally disposed apertures in an abutting relationship with both guide magnets. The core has at least one core gap. A drive coil is wound around both guide magnet pole faces. An orbit control coil has a core portion wound around the core gap and a field portion wound around the guide magnet pole faces. The core portion and the field portion are connected but in opposite polarity.

31 Claims, 9 Drawing Sheets

INTERNAL INJECTION BETATRON

CROSS REFERENCE TO RELATED APPLICATION(S)

This patent application claims priority from U.S. patent application Ser. No. 11/957,178 filed Dec. 14, 2007,incorporated by reference herein in its entirety.

BACKGROUND OF THE INVENTION

1. Field of the Invention

This invention generally relates to methods and devices of formation evaluation using a switchable source, in particular, injecting electrons near the inner radius of a vacuum donut of a compact betatron electron accelerator.

2. Background of the Invention

Known methods and devices of formation evaluation are typically used in oil well bore hole logging applications, such applications are understood as a process where properties of earth strata as a function of depth in the bore hole are measured. For example, geologists reviewing the logging data can determine the depths at which oil containing formations are most likely located. One important piece of the logging data is the density of the earth formation. Most present day well logging relies on gamma-rays obtained from chemical radiation sources to determine the bulk density of the formation surrounding a borehole. These sources pose a radiation hazard and require strict controls to prevent accidental exposure or intentional misuse. In addition, most sources have a long half life and disposal is a significant issue. For some logging applications, in particular determination of formation density, a $^{137}$Cs source or a $^{60}$Co source is used to irradiate the formation. The intensity and penetrating nature of the radiation allow a rapid, accurate, measurement of the formation density. In view of the problems with chemical radiation sources, it is important that chemical radiation sources be replaced by electronic radiation sources.

One proposed replacement for chemical gamma-ray sources is a betatron accelerator. In this device, electrons are accelerated on a circular path by a varying magnetic field until being directed onto a target. The interaction of the electrons with the target leads to the emission of Bremsstrahlung and characteristic x-rays of the target material. Before electrons can be accelerated, they are injected into a magnetic field between two circular pole faces at the right time, with correct energy and correct angle. Control over timing, energy and injection angle enables maximizing the number of electrons accepted into a main electron orbit and accelerated.

A typical betatron, as disclosed in U.S. Pat. No. 5,122,662 to Chen et al. has a pole face diameter of about 4.5 inches. The magnet consists of two separated, magnetically isolated pieces: a core with a magnetic circuit that is a nearly closed loop and a guide field magnet that includes two opposing pole faces separated by a gap of about 1 centimeter. The pole faces that encompass the core have a toroidal shape. A gap of about 0.5 cm separates the core from the inner rims of the pole faces. The two pieces are driven by two separated sets of coils connected in parallel: a field coil wound around the outer rims of the pole faces and a core coil wound on a center section of the core. The field magnet and the core are magnetically decoupled with a reverse field coil wound on top of the core coil. Both the core coil and the reverse field coil locate in the 0.5 cm gap. U.S. Pat. No. 5,122,662 is incorporated by reference in its entirety herein.

In operation, a typical betatron satisfies the betatron condition and accelerates electrons to relativistic velocity. The betatron condition is satisfied when:

$$\Delta\phi_0 = 2\pi r^2_0 \Delta B_{y,0} \quad (1)$$

where:

$r_0$ is the radius of a betatron orbit located approximately at the center of the pole faces;

$\Delta\phi_0$ is the change of flux enclosed within $r_0$; and $\Delta B_{y,0}$ is the change in guide field at $r_0$.

The betatron condition may be met by adjusting the core coil to guide field coil turn ratio as disclosed in U.S. Pat. No. 5,122,662. Satisfying the betatron condition does not insure the machine will work. Charge trapping, injecting electrons into the betatron orbit at the optimal point of time, is another challenging operation. In the 4.5 inch betatron, this is accomplished by holding the flux in the core constant while increasing the guide field. It can be done because the core and guide field are driven independently.

Large betatrons are suitable for applications where size constraints are not critical, such as to generate x-rays for medical radiation purposes. However, in applications such as oil well bore holes where there are severe size constraints, it is desired to use smaller betatrons, typically with a magnetic field diameter of three inches or less. The conventional design for large betatrons is not readily applied to smaller betatrons for at least three reasons:

(1) If the electron injector is located in the gap between pole faces, the gap height must be larger than the dimension of the injector perpendicular to the pole faces. In order to maintain a reasonable beam aperture, the width of the pole faces cannot be reduced too much either. Thus, the burden of the size reduction falls mostly on the core, resulting in significantly lower beam energy.

(2) If the electron injector is located in the gap between the pole faces, one must, within a time period comparable to the orbit period of electrons, alter the injected electrons trajectories such that they do not hit the injector. Those electrons whose trajectories do not intercept either the injector structure or the vacuum chamber walls are said to be trapped. Only trapped electrons may be accelerated to full energy and caused to impinge on the target and produce radiation. Due to the nature of the charge trapping mechanism, the probability of trapping any charge in a 3 inch machine is almost nil unless the modulation frequency of the main drive is increased to about 24 kHz (triple that of a 4.5 inch machine) and the injection energy is reduced to about 2.5 kV (½ that of the 4.5 inch machine). Even then, the prospect of trapping a charge comparable to that trapped in a 4.5 inch machine is poor.

(3) A higher flux density is required to confine the same energy electrons to a smaller radius. A higher flux density and modulation frequency results in a higher power loss in a three inch betatron, even though it has a smaller volume than a 4.5 inch betatron.

As a result of (1)-(3), it is estimated that the useable radiation output of a three inch betatron with the conventional design would be three orders of magnitude lower than the 4.5 inch betatron. There exists a need for a small diameter betatron having a radiation output comparable to the 4.5 inch betatron.

Further, the source intensity from a betatron can depend on several factors, for example, the number of electrons hitting the target and the energy of those electrons. The energy of the electrons can be limited by material properties and available power whereas the former is mainly an issue of the amount of charge trapped, which is in turn affected by strength of the focusing forces, the space charge forces, and the efficiency of the charge trapping mechanism. The trapped charge is always less than the maximum allowed charge because the mechanism isn't 100% efficient. For example, the conventional approach uses an external injection scheme which provides for inefficient trapping in a small betatron.

In a small circular electron accelerator such as a betatron, injection of elections into the acceleration cavity poses a significant challenge. The betatron is a fix orbit machine. Namely, during acceleration the radius of the accelerating beam remains more or less constant. Injection is often done by installing the injector just outside the radius of the main accelerating beam orbit. To avoid hitting the injector, the orbit radius of the injected beam is contracted rapidly. The process reverses after the electron beam has reached the desired energy. As the electron beam expands, it impinges on the first structure (target) it encounters to produce radiation.

Therefore, there is a need for sourceless formation evaluation devices and methods that overcome the above noted limitations of the prior art.

SUMMARY OF THE INVENTION

According to an embodiment of the invention, the invention can include a betatron magnet having at least one electron injector positioned approximate the inside of the radius of the betatron orbit. The betatron magnet can comprise of a betatron magnet having a circular, donut shaped guide magnet, and a core disposed in the center, and abutting the guide magnet and one or more peripheral return yokes. Further, a guide magnet gap separating the guide magnet into an upper portion and a lower portion with opposing pole faces. A drive coil that is wound around the guide magnet pole faces. An orbit control coil having a core portion wound around the core and a field portion wound around the pole faces of the guide magnet. The core portion and the field portion can be connected in series but in opposite polarities. However, it is noted that the core portion and the field portion can be driven independently. Further, a circuit can provide voltage pulses to the drive coil and to the orbit control coil. Magnetic fluxes in the core and in the guide magnet return through two peripheral portions, or return yokes, of the betatron magnet. An evacuated electron acceleration passageway disposed in the guide magnet gap contains electrons which are accelerated to a relativistic velocity and then caused to impact a target thereby generating x-rays, such that electrons are injected into the electron orbit with the at least one electron injector positioned approximate the inside of the radius of the betatron orbit within the electron acceleration passageway.

Operation of this betatron can include forming a first magnetic flux of a first polarity that passes through the guide magnet, the electron acceleration passageway and the core and then returns through the return yokes, and a second magnetic flux of either the first polarity or of an opposing second polarity that passes through the core and returns through the guide magnet gap and the electron acceleration passageway. At the beginning of each cycle, a high voltage pulse (typically a few kV) is applied to the injector and causes electrons to be injected into the electron acceleration passageway. To achieve fast contraction without compromising the maximum energy the core is a hybrid core having a perimeter portion made of fast ferrite surrounding a slower, but high saturation flux density material. During the first time period most of the flux needed to reduce the radius of electron orbits flows through the fast ferrite. After this first time duration, the fast ferrite perimeter of the core magnetically saturates and the second magnetic flux then flows through the internal portion of the core and in combination with the first magnetic flux accelerates the electrons. The polarity of the second magnetic flux is reversed when the electrons approach a maximum velocity thereby expanding the electron orbit and causing the electrons to impact a target generating x-rays.

According to an aspect of the invention, the invention can include the core as being a hybrid having a high saturation flux density central portion and a perimeter formed from a fast response highly permeable magnetic material. Further, the central portion can be an amorphous metal and the perimeter can be a ferrite with a magnetic permeability in excess of 100. Further still, the invention can include a cumulative width of the at least one core gap that is effective to satisfy a betatron condition. It is possible the invention can include the cumulative width of the at least one core gap to be approximately between 2 millimeters and 2.5 millimeters. Further, the invention can include the at least one core gap to be formed of multiple gaps. Further still, the invention can include diameters of both the first pole face and the second pole face that are approximately between 2.75 inch and 3.75 inch. It is also possible the invention can include a turn ratio of the core portion windings to the field portion windings to be 2:1. Further, the invention can include a turn ratio of the drive coil windings to the field portion windings to be at least 10:1 and the number of drive coil windings to be at least 10. Further still, the invention can include a circuit providing a nominal peak current of 170A and a nominal peak voltage of 900V. It is also possible the invention can include affixed to a sonde effective for insertion into an oil well bore hole.

According to an embodiment of the invention, the invention may include a method to generate x-rays. The method can include the steps of providing a betatron magnet that includes a first guide magnet having a first pole face and a second guide magnet having a second pole face. Further, both the first guide magnet and the second guide magnet can have a centrally disposed aperture, wherein the first pole face is separated from the second pole face by a guide magnet gap. Further the method can include the steps of a core disposed within the centrally disposed apertures, in an abutting relationship with both the first guide magnet and the second guide magnet. Further, the core can have at least one core gap that includes circumscribing the guide magnet gap with an electron passageway. Further, the method includes the steps of forming a first magnetic flux of a first polarity to an opposing second polarity that passes through central portions of the betatron magnet and the core as well as through the electron passageway and then returns through peripheral portions of the betatron magnet. The method further includes the steps of injecting electrons into an electron orbit within the electron passageway when the first magnetic flux is at approximately a minimum strength at the first polarity, such that the electrons are injected with at least one electron injector positioned approximate along an inside of a radius of the electron orbit. Further, the method includes the steps of forming a second magnetic flux at the opposing second polarity that passes through the electron passageway and the first polarity through a perimeter of the core and returns through the electron passageway in the opposing second polarity for a first time effective to expand the injected electron orbits to an optimal betatron orbit,e.g., this is for internal injection only. The method also includes the steps of after the first time the perimeter of the core magnetically saturates and the second magnetic flux passes through an interior portion of the core and in combination with the first magnetic flux, accelerates the electrons whereby enforcing a flux forcing condition. The method further includes the steps of applying the second magnetic flux when the first magnetic flux approached a maximum strength thereby expanding the electron orbit causing the electrons to impact a target causing an emission of x-rays.

According to embodiments of the invention, the invention may include providing for a device for driving at least one injector for an internal injection scheme for a betatron magnet. The betatron magnet can include at least one electron injector positioned approximate an inside of a radius of a betatron orbit. Such that electrons are injected into the betatron orbit with the at least one electron injector positioned within an electron acceleration passageway. Further, the at least one electron injector can be driven with a positive high voltage pulse to an anode, such that a circuit (or external circuit) feeds the positive high voltage pulse to the anode through an outside wall of an evacuated chamber containing the electron acceleration passageway and through a resistive coating on an interior surface of the evacuated chamber. The positive high voltage pulse applied to the anode extracts electrons from a cathode, whereby after electrons leave the at least one electron injector the electrons enter a free space of equal-potential (known as Faraday's cage) contained within at least a portion of surfaces of the resistive coating of the evacuated chamber, such that at least one electric lead, e.g., a single electric lead may be possible, enters through an inside wall of the evacuated chamber and is in connection to the cathode, which is at ground potential.

According to embodiments of the invention, the invention may include methods for driving at least one electron injector for an internal injection scheme of a betatron magnet. The method includes injecting electrons into an betatron orbit with the at least one electron injector positioned within an electron acceleration passageway, wherein the at least one electron injector positioned approximate an inside of a radius of an betatron orbit. The further includes driving the at least one electron injector with a positive high voltage pulse to an anode, such that a circuit feeds the positive high voltage pulse to the anode through an outside wall of an evacuated chamber containing the electron acceleration passageway and through a resistive coating on an interior surface of the evacuated chamber. The method includes applying the positive high voltage pulse to the anode so as to extract electrons from a cathode, whereby after electrons leave the at least one electron injector. Further, the electrons enter a free space of equal-potential contained within at least a portion of surfaces of the resistive coating of the evacuated chamber, such that at least one electric lead enters through an inside wall of the evacuated chamber and is in connection to the cathode, which is at ground potential.

According to at least one aspect of the invention, the invention can include the second magnetic flux to be formed by energizing a core portion of a orbit control coil wound around the at least one core gap. Further, a return portion of the second magnetic flux in the peripheral portions of the betatron magnet maybe cancelled by a flux generated by a field portion of the orbit control coil wound around both the first pole face and the second pole face. It is possible, the field portion can be electrically connected in series, but at opposite polarity, to the core portion.

According to at least one aspect of the invention, the invention can include a turn ratio of field portion to the core portion is effective to cause the second flux to return through the electron passageway. Further, shorting the orbit control coil can be effective to enforce the flux forcing condition. Further still, the invention may have a turn ratio of core portion windings to field portion windings is 2:1. It is also possible the invention can include forming the core as a hybrid having a high saturation flux density interior and a fast response permeable perimeter.

According to at least one aspect of the invention, the invention can include the first time is on the order of 100 nanoseconds. Further, a time from minimum strength at the first polarity to maximum strength at the first polarity can be on the order of 30 microseconds. Further still, the first magnetic flux and the second magnetic flux can be effective to accelerate the electrons to in excess of 1 MeV. It is possible a turn ratio of the drive coil windings to the field portion windings can be 10:1.

According to at least one aspect of the invention, the invention can include the drive coil this is driven by a modulating circuit that provides a cycling voltage with a nominal peak current of 170A and nominal peak voltage of 900V. Further, the voltage cycles can be at a nominal rate of 2 kHz. It is possible the orbit control coil can be pulsed to 120-150 volts during electron orbit expansion or contraction and shorted during electron acceleration. Further still, the x-rays can be directed at subsurface formation formations access via an oil well bore hole.

According to at least one embodiment of the invention, the invention can include a betatron magnet having at least one electron injector positioned approximate an inside of a radius of the betatron orbit along with using at least one separated target placed approximate an outer edge of the betatron magnet. The betatron magnet can comprise of a first guide magnet having a first pole face and a second guide magnet having a second pole face and both the first guide magnet and the second guide magnet having a centrally disposed aperture, wherein the first pole face is separated from the second pole face by a guide magnet gap. Further, a core disposed within the centrally disposed apertures, in an abutting relationship with both the first guide magnet and the second guide magnet, the core having at least one core gap. Further still, a drive coil wound around the first pole face and the second pole face. Further, an orbit control coil having a core portion wound around the at least one core gap and a field portion wound around both the first pole face and the second pole face, the core portion and the field portion are connected in series but in opposite polarity. Further still, wherein magnet fluxes in the core and the first and the second guide magnets return through one or more peripheral portions of the betatron magnet, as well as a circuit effective to provide voltage pulses to the drive coil and to the orbit control coil. Finally, an electron acceleration passageway located within the guide magnet gap, such that electrons are injected with the at least one electron injector positioned approximate the inside of the radius of the betatron orbit along with using the at least one separated target placed approximate the outer edge of the betatron magnet.

The disclosed betatron can be compact and suitable for attachment to a sonde for lowering into an oil well bore hole or used in other measurement related applications either on the surface or in subterranean environments, e.g., including but not limiting of such industries as explosive, chemical, medical, printing, etc. The products of interaction of the generated x-rays with ground formations are useful for a geologist to determine characteristics of earth formations, such as density as well as likely locations of subterranean oil deposit.

Further features and advantages of the invention will become more readily apparent from the following detailed description when taken in conjunction with the accompanying drawings.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PREFERRED EMBODIMENTS

Figure 1:
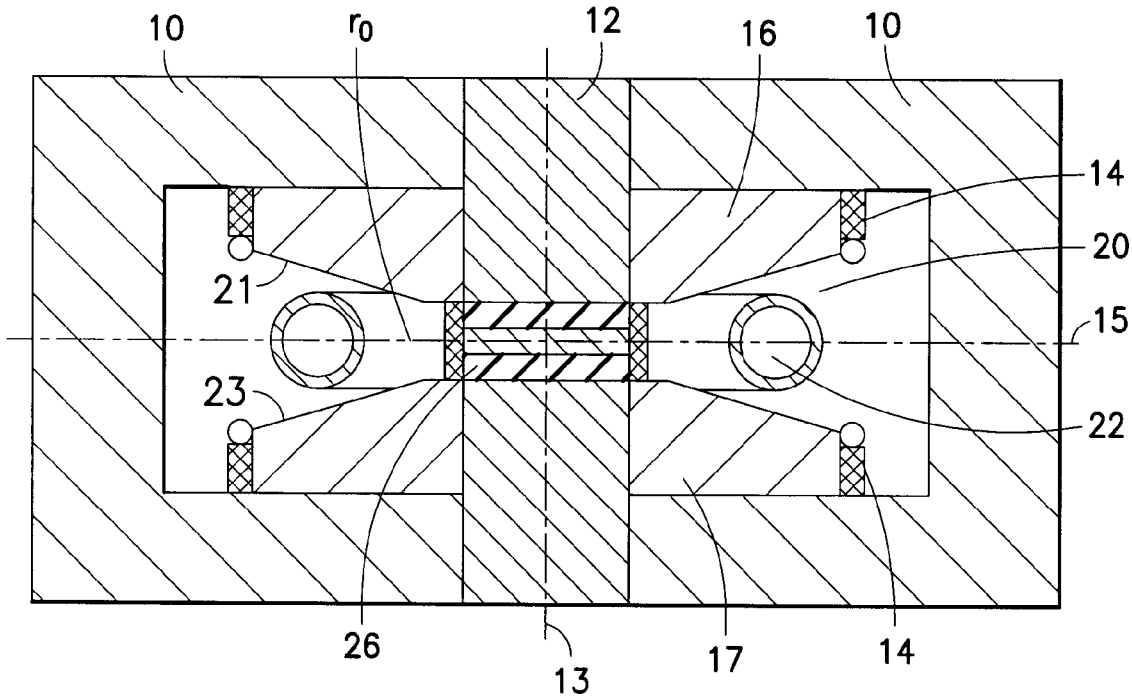
FIG. 1 illustrates in cross sectional representation the magnet configuration and drive coil of a small diameter betatron design according to the device of U.S. patent application Ser. No. 11/957,178.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice. Further, like reference numbers and designations in the various drawings indicated like elements.

According to embodiments of the invention, the invention includes a betatron magnet having at least one electron injector positioned approximate an inside of a radius of the betatron orbit, the betatron magnet comprising; the betatron magnet with a first guide magnet having a first pole face and a second guide magnet having a second pole face. Both the first and the second guide magnet have a centrally disposed aperture and the first pole face is separated from the second pole face by a guide magnet gap. A core is disposed within the centrally disposed apertures in an abutting relationship with both guide magnets. The core has at least one core gap. A drive coil is wound around both guide magnet pole faces. An orbit control coil has a core portion wound around the core gap and a field portion wound around the guide magnet pole faces. The core portion and the field portion are connected in series but in opposite polarity, such that the betatron magnet has at least one electron injector positioned approximate the inside of the radius of the betatron orbit.

Brief Overview of Embodiments of the Invention

According to embodiments of the invention, the invention includes injecting electrons into the vacuum donut of a very small diameter betatron (3.5" or less), by injecting electrons near the inner radius of the vacuum donut, as oppose to the conventional approach of injecting near the outer radius. At least one advantage of this geometry is that it significantly improves the efficiency of a previously disclosed electron trapping scheme U.S. patent application Ser. No. 11/957,178 to Chen et al. filed Dec. 14, 2007 (hereafter "Chen device") assigned to the assignee of the present invention, which results to a much higher radiation output. For example, the radiation output is increased in the present invention by placing the electron injector inside the radius of the main electron orbit and using a separate target placed near the outer edge of the betatron magnet. It is noted the present invention has a different geometry than the Chen device which provides for injecting electrons near the inner radius of the vacuum donut. In contrast to the Chen device, the electron orbit expands rather than contracts following injection. Accordingly, the electric impulse applied to the orbit control coil is in opposite polarity to that of external injection.

Review of the U.S. patent application Ser. No. 11/957,178

In order to better understand the present invention, it would be beneficial to review several aspects of the device as disclosed in U.S. patent application Ser. No. 11/957,178 to Chen et al. (hereafter "Chen device"). As noted above the Chen device follows the convention approach of injecting the electrons near the outer radius of the vacuum donut. For example, the Chen device discloses a betatron magnet having a circular, donut shaped guide magnet and a core disposed in the center and abutting the guide magnet. A guide magnet gap separates the guide magnet into upper and lower portions with opposing pole faces, and a drive coil is wound around the guide magnet pole faces. The Chen device also shows an orbit control coil having a core portion wound around the core and a field portion wound around the pole faces of the guide magnet. The core portion and the field portion can be connected in series but in opposite polarities. However, it is noted that the core portion and the field portion of the Chen device can be driven independently. Further, the Chen device shows a circuit that can provide voltage pulses to the drive coil and to the orbit control coil. Magnetic fluxes in the core and guide magnets return through peripheral portions of the betatron magnet, which are called return yokes. The Chen device further includes an evacuated tube that encompasses an electron acceleration passageway and is disposed in a space between the guide magnet pole faces. Electrons are accelerated to a relativistic velocity in this passageway and then caused to impact a target. As electrons decelerate rapidly and ionized target atoms recover from the impact and returns to a lower energy state, x-rays are emitted. Operation of the Chen device includes forming a first magnetic flux of a first polarity that passes through the guide magnet pole faces, the electron acceleration passageway and the core and then returns through the return yokes, and forming a second magnetic flux of either the first polarity or of an opposing second polarity that passes through the core and returns through the guide magnet pole faces and the electron acceleration passageway.

In particular, the Chen device in FIG. 1 illustrates a cross sectional representation of a betatron magnet, return yokes 10, first guide magnet 16 and second guide magnet 17 encircling a magnetic core 12. As noted above the Chen device follows the convention approach of injecting the electrons near the outer radius of the vacuum donut. Further, both guide magnets 16, 17 and the core 12 have substantial radial symmetry about longitudinal axis 13, and mirror symmetry about a mid plane 15. The guide magnets 16, 17 are formed from a soft magnetic material, such as MND5700 ferrite manufactured by Ceramic Magnetics, Inc. of Fairfield, N.J., having a high permeability, such as about 2000, to readily conduct a magnetic flux. Due to the one or more gaps 26 in the magnetic core 12, the magnetic permeability of the betatron magnet has little effect on the magnetic properties that accelerate and direct the electrons, as long as the permeability is sufficiently high, such as about 2000. The gaps 26 may be air gaps or spacers formed from a non-magnetic material and non-conductive. The return yokes 10 may be formed from a magnetic material such as ferrite or, similar to the core described below as a hybrid having both an amorphous metal and a ferrite component. The Chen device illustrates the magnetic core 12 that may have a composite a high saturation flux density interior and a fast but lower saturation flux density periphery, or vice versa. The main drive coil 14 is shown wound around both guide magnets 16, 17 of the betatron magnet. Typically, but not necessarily, the main drive coil 14 will have ten or more windings to reduce power consumption and have a suitable first magnetic flux rise time in relationship to the injector pulse rise time. Activation of the main drive coil 14 creates magnetic flux that confines and accelerates electrons contained within passageway 20. Passageway 20 is a region in space between the pole faces 21, 23 of the guide magnets. Stable instantaneous equilibrium electron orbits and focusing conditions of electrons exist within the confines of the passageway 20. Further, FIG. 1 shows contained within the passageway 20 a toroid shaped tube 22 formed from a low thermal expansion glass or ceramic whose interior surfaces are coated with a suitable resistive coating, such as 100-1000 ohms per square. When grounded, the coating prevents excessive surface charge buildup, which has a detrimental effect on the circulating electron beam. During betatron operation, the interior volume of the tube 22 is under a vacuum of about $1\times10^{-8}$ torr to about $1\times10^{-9}$ torr to minimize electron loss from collisions with residual gas molecules. The interior volume of the tube 22 overlaps the passageway 20 in such a way that stable instantaneous orbits do not intercept the tube wall.

Figure 2:
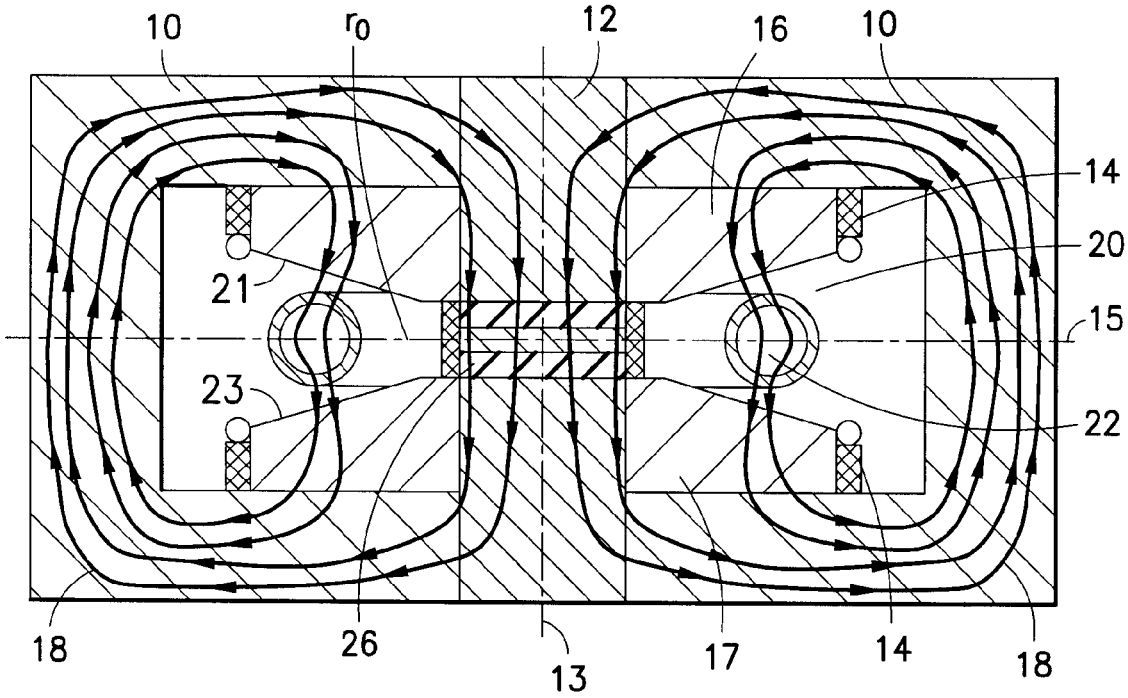
FIG. 2 illustrates the magnet configuration of FIG. 1 showing magnetic flux lines generated by the drive coil according to the device of U.S. patent application Ser. No. 11/957,178.

Further, the Chen device in FIG. 2 shows the betatron magnet with flux lines 18 illustrating the magnetic field created by energizing the main drive coil 14. Further, the Chen device shows that at the beginning of each cycle, a high voltage pulse (typically a few kV) is applied to the injector and causes electrons to be injected into the electron acceleration passageway. It is preferable, but not necessary, to design the shape of the injector voltage pulse such that the energy of the injected electrons increases at an appropriate rate in relationship to the rising guide magnetic field in the acceleration passageway over a period of 100 nanoseconds or more. The period during which the match condition between the injector voltage pulse and the first magnetic flux in the passageway exists is referred to as the injection window. Electrons injected within the injection window have the highest probability of being trapped. The matched condition is best described by the concept of instantaneous equilibrium orbit of radius, $r_i$. At the instantaneous equilibrium orbit the magnetic bending force is equals to the centrifugal force. At $r>r_i$, the magnetic bending force is greater whereas the opposite is true for $r<r_i$. Thus, electrons associated with a given $r_i$ are bound to $r_i$ much like a ball attached to a point through a spring. The injection window is the time period during which $r_i$ is located inside the passageway. Unlike $r_0$ which is determined by the design of the magnet and prescribes how the main drive flux (first magnetic flux) is partitioned between different parts of the magnet, $r_i$ is a function of the electron energy and magnetic field at $r_i$. If an electron is injected at $r=r_i$ and tangent to the circle, its trajectory will follow the circle and intercept the injector in its first revolution. It is therefore preferable to inject electrons such that $r_i$ is either smaller (if the injector is located near the outside edge of the passageway) or larger (if the injector is located near the inside edge of the passageway) than the radius of injection. The trajectories of electrons injected at $r\neq r_i$ and/or at an angle to the tangent of the injection circle, r, will oscillate with respect to $r_i$ (betatron oscillation). As the first magnetic flux increases, the amplitude of the oscillation reduces and $r_i$ moves closer to $r_0$ (betatron damping). The oscillatory trajectories may cause electrons to miss the injector in the first few revolutions but electrons will eventually hit the injector unless the betatron damping is sufficiently fast or a second magnetic flux is introduced to alter $r_i$ in such a way that certain electron trajectories do not intercept the injector.

To illustrate the sequence of operation in the Chen device which follows the convention approach of injecting the electrons near the outer radius of the vacuum donut, consider an example in which the injection takes place near the outside edge of the passageway and $r_i$ lies just inside the injector structure. At the beginning of the injection window, a second magnetic flux is formed for a first time duration that passes mainly through a perimeter of the core at an opposing second polarity and returns through the electron passageway at the first polarity. The reducing flux within the core induces a deceleration electric field in the passageway, and at the same time the returning second magnetic flux through the passageway causes an increase of the magnetic field in the vicinity of electron trajectories.

Figure 3:
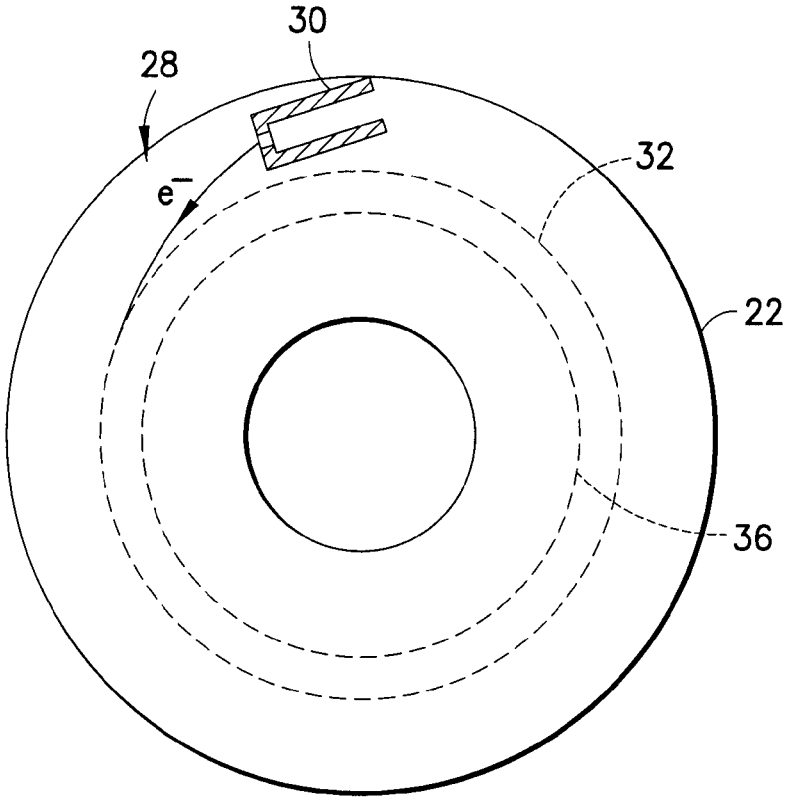
FIG. 3 illustrates a path for electrons injected into the betatron of FIG. 1 according to the device of U.S. patent application Ser. No. 11/957,178.

The Chen device as disclosed in FIG. 3 illustrates the interior volume of the tube 22 in latitudinal cross section. Electrons 28 are injected into the volume from an electron emitter 30, such as a thermal emission dispenser cathode. For an electron 28 injected at a specific energy that injects electrons near the outer radius of the vacuum donut, there is a corresponding orbit at the instantaneous equilibrium radius, $r_i$ 32 such that the magnetic bending force is equal and opposite to the centrifugal force. An electron injected into the betatron magnet at a location either inside or outside $r_i$ 32 will exhibit a track having oscillatory motion about $r_i$ and this oscillation is referred to as the betatron oscillation. The betatron oscillation frequency is slower than the orbital frequency such that the electron completes one or more revolutions around the volume per betatron oscillation. As the magnetic field increases, the betatron oscillation amplitude reduces and $r_i$ 32 moves closer to the betatron orbit 36 $r_o$ (betatron damping) the terminus of the radius (22 in FIG. 1). To avoid hitting the injector 30 in a small betatron one needs to change $r_i$ at a faster rate than the intrinsic betatron damping rate.

Description of Embodiments of the Invention

As noted above an electron injector in a conventional betatron typically situates near the outer rim of the betatron vacuum donut simply for reason for the ease of implementation. In this geometry feeding the high voltage necessary for driving the injector through the vacuum wall is relatively straightforward. After electrons leave the injector, an orbit control mechanism as described in the Chen device causes the electron orbit to contract and a portion of the injected electrons are trapped in stable orbits and accelerated to full energy. However, with an external injection, e.g., the conventional approach, there are several drawbacks:

1) the orbit contraction mechanism leads to a severely miss matched magnetic field and electron energy, hence, a very narrow injection window and low trapped charge; and
2) for practical considerations, the target should always be located near the outer radius of the donut. By default, it is the inner most physical structure the expanding electron beam hits. Since the target will also intercept injected electrons, it is best to make it part of the injector structure to avoid alignment issue.

In other words, the target location is dictated by injection requirements, is not an optimal radiation output. The injection requirements are such that the orbit expansion at peak electron energy is extremely slow (a few μm per turn) in the vicinity of the target. Consequently, electrons always impinge near the inner most layer of the target, and nearly half of the electrons scatter off the target without producing much γ rays. Of course, those escaped electrons will still produce some radiation as they hit and penetrate the interior vacuum donut wall. However, most of those γ rays don't make it out of the magnet and shielding. They are also not always reproducible and therefore not useful for measurement purposes.

In comparison, an internal injection overcomes both of the above noted problems. In addition, since the target and the injector are decoupled, one can conceivably install multiple injectors along the inside rim. Multiple injectors spread out space charge and allows for more efficient charge packing. The main challenge of the internal injection is how to resolve the difficult issue of driving the injector, especially in a very small betatron with extremely limited internal space available. According to aspects of the invention, the invention provides a novel but yet simple solution to the above noted problems.

The source intensity from the betatron depends on two factors: the number of electrons hitting the target and the energy of those electrons. The latter is limited by material properties and available power whereas the former is mainly an issue of the amount of charge trapped, which is in turn affected by strength of the focusing forces, the space charge forces, and the efficiency of the charge trapping mechanism.

In a circular orbit machine, three different forces influence the electron motion: (1) the centrifugal force that always lies on the radial plane and pointing outwards; (2) the vertical and radial magnetic bending forces; and (3) the space charge force that also has a vertical and a radial component. The betatron pole faces of at least one embodiment of the present invention are shaped so that the vertical magnetic force always points toward the mid-plane. In other words, it is always focusing. The radial focusing force is the difference between the radial magnetic bending force and the centrifugal force. It may either be focusing or defocusing depending on the pole face shape and the electron location. The space charge forces are always repulsive and point away from the charge center.

Figure 4:
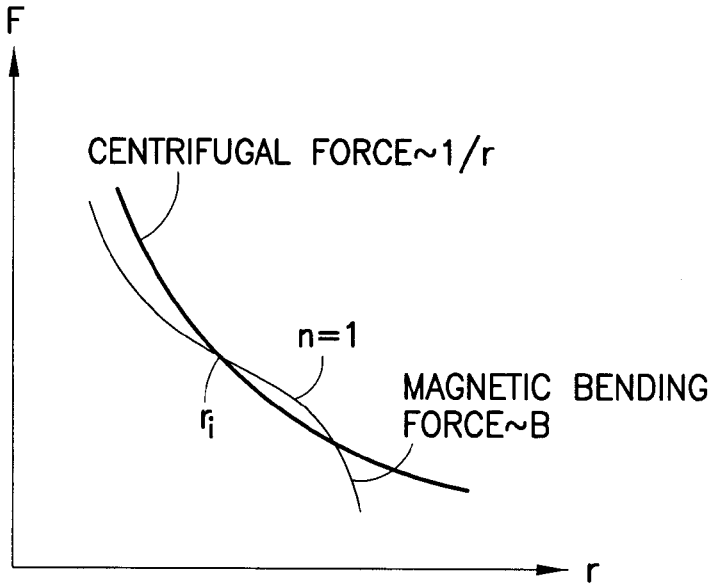
FIG. 4 illustrates the relationship between the centrifugal and radial magnetic bending forces, so as to give rise to the radial focusing according to an embodiment of the invention.

For the purpose of trapping charge, the relevant forces are the radial forces. FIG. 4 illustrates the relationship between the centrifugal force and radial betatron focusing force. The location where the two forces intersect is the instantaneous equilibrium orbit $r_i$. Because the centrifugal force falls off as 1/r, $r_i$ cannot exist outside field index n=1. There are two intersects in FIG. 4 but only the inner one is a stable equilibrium orbit. The outer one isn't a stable orbit because the net radial force is defocusing.

Figure 5:
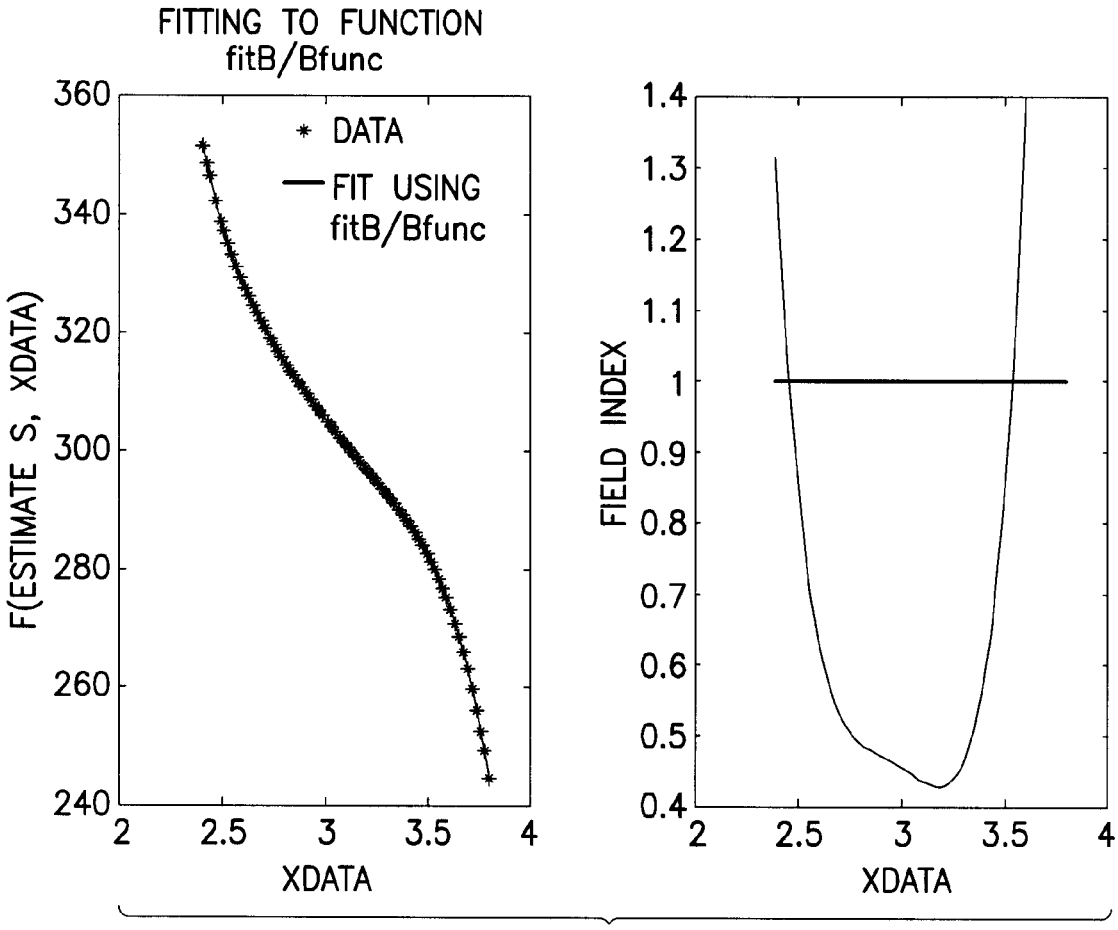
FIG. 5 illustrates the fitting results to Torsca data, wherein the field index n<1 is between 2.45 and 3.55 cm according to an aspect of the invention.

The maximum possible charge that may be trapped is also determined by the size of the betatron aperture and physical obstacles within the aperture. The betatron aperture defines a region between the betatron pole faces where stable orbits may exist. FIG. 5 shows the magnetic field map and field index map of the present 3.0" betatron. In particular, the fitting results to Torsca data, where the field index n<1 is approximately between 2.45 and 3.55 cm. Further, stable orbits may exist between approximately 2.6 and 3.5 cm. Physical obstacles that reduce the available aperture include the top and bottom vacuum walls, and the injector structure, which is placed near the outside boundary of the aperture in the 3" design. The maximum charge that may be confined within the aperture is dictated by the requirement that the space charge forces must be weaker than the focusing forces. Since the focusing forces increase with electron energy, the maximum allowable charge that may be confined within the aperture increases with injection energy. It is important to realize that the maximum allowed charge isn't the same as the trapped charge. Since the injector blocks the electron path a mechanism is needed to move electrons inwards, away from the injector, and into stable orbits. Trapped charge is always less than the maximum allowed charge because the mechanism isn't 100% efficient. According to aspects of the invention, the invention discloses an alternative approach to commonly used external injection scheme that significantly improves the trapping efficiency in a small betatron.

In an external Injection, one traps injected charge by manipulating $r_i$. If the injection position is near the outside of the aperture, as in the Chen device of the present 3.5" betatron design, $r_i$ contracts immediately after injection. Referring to FIG. 4, one achieves this either by lowering the centrifugal force by decelerating the electron, or increasing the magnetic bending force by rapidly increasing the magnetic field. Both components are present in the contraction scheme employed in the current design. For given amount of changes in electron energy and magnetic field, the inward speed at which $r_i$ moves depends on the local curvature of radial magnetic bending force. It is the fastest near n=1 where the radial focusing is the weakest.

Figure 6:
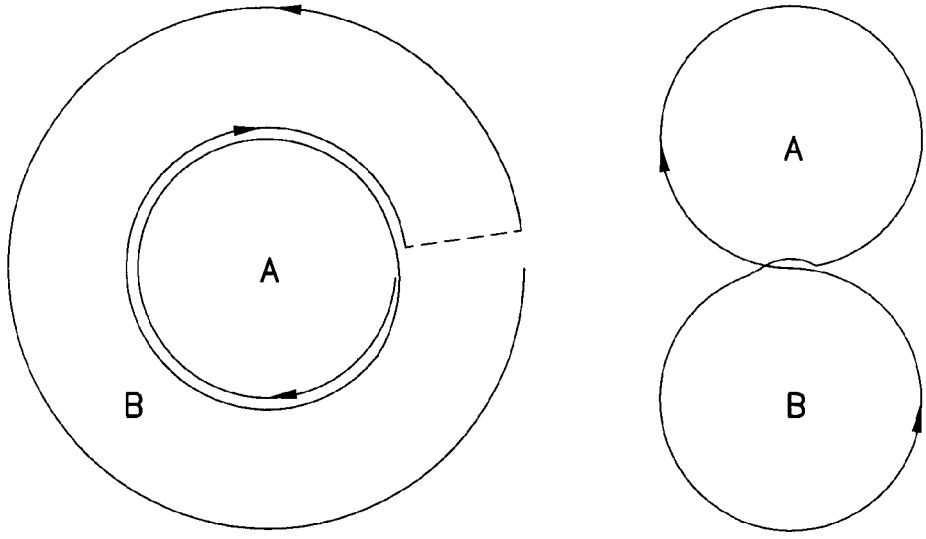
FIG. 6 illustrates the orbit control coil configuration, such that the contraction current in the single outside loop (the field portion) is in the same direction as the main drive current according to an aspect of the invention.

The main component of the orbit contraction scheme is equivalent to a coil in the shape of a FIG. 8 as illustrated in FIG. 6, where region A is the area within the core portion of the orbit control coil and region B is the area outside the core between the core portion and field portion of the orbit control coil. The FIG. 8 configuration guarantees the flux in A is always equal to the flux in B but in opposite polarity, and the orbit control coil depicted in FIG. 6 is decoupled from the main drive coil that wraps around both A and B. Orbit contraction is initiated by a contraction voltage applied to the orbit control coil in a polarity such that the flux in A due to the contraction voltage is in opposite polarity to the main drive coil, hence leads to a deceleration force. In the meantime, the flux in B enhances the net magnetic field in the orbital region and further pushes the electrons inwards. The relative contributions of the two orbit contraction processes depend on the electron location. For external injection, the initial rate of contraction flux change within the electron orbit is quite small (because contraction flux in A is mostly offset by its counterpart in B that lies within the injection orbit), and contraction is due mainly to the rapid increase in the magnetic field. Although this orbit manipulation scheme requires a minimum space to implement, it nevertheless creates an undesirable mismatch between subsequent injection energy and the magnetic field.

To trap the maximum possible charge, at least one advantageous approach can include to strive to stack the beam in an orderly fashion so that the charge distribution inside the betatron aperture is uniform. Non-uniform charge distribution almost always implies less than optimal charge trapping. It also leads to emittance growth and charge loss later.

At least one of the important parameters to consider for orbit contraction include the injection location defined by the initial central ray location $r_c$ (which is at the center of the injector anode opening), the injection beam energy and current, the injection angle, placement of the initial instantaneous orbit $r_i$, the initial beam envelope, beam envelope angle and beam emittance. At least one of the very first objectives is to make sure the injected beam misses the injector structure in its first few revolutions. Depending on the injected beam quality (envelope, envelope angle and emittance) it may or may not be possible to avoid hitting the injector entirely. To miss the injector entirely $r_c$ must clear the injector structure by at least the width of the beam envelope. Nevertheless, we may assume that half of the charge should enter the aperture if the central ray just barely misses the injector. For illustration purposes it suffices to consider only central ray dynamics.

Where to place the initial $r_i$ relative to $r_c$ can be one of the most important considerations that affect the trapping efficiency. In the current injector design, and according to at least one embodiment, the inner most point of the structure (the target) extends inwards by ~1.5 mm from $r_c$. To make the best use of the betatron aperture, it is desirable to place the injector as far outside as possible. It was discussed above that $r_i$ can exist only inside the circle of n=1, or in our case, inside 3.5 cm. This, however, doesn't preclude placing the central ray of the beam, $r_c$, in the area between the two intersects in FIG. 4. An initial displacement between $r_i$ and $r_c$ can almost always result in some betatron oscillation even though one has some control of the oscillation amplitude by adjusting the injection angle. Presence of some small betatron oscillation may or may not be advantageous depending on other injection parameters. Because radial betatron oscillation frequency is lower than electron orbital frequency, one can take advantage of the phase difference to cause the central ray of the beam to miss the injector. On the other hand, large betatron oscillation amplitude also means a large beam radial foot print, which implies fewer revolutions may be stored in the aperture. At least one alternative is to place the initial $r_i$ to coincide with $r_c$ at the cost of a reduced available aperture. An example is given in FIG. 7*a*. With a properly chosen injection angle one can almost completely eliminate the betatron oscillation. With the given contraction speed, $r_i$ moves inwards by about 2 mm in its first revolution, and $r_c$ clears the injector by ~0.2 mm. At least in one ideal scenario electrons leaving the injector at a later time would continuously spiral inwards in the same fashion and fill up the aperture uniformly.

Figure 7A:
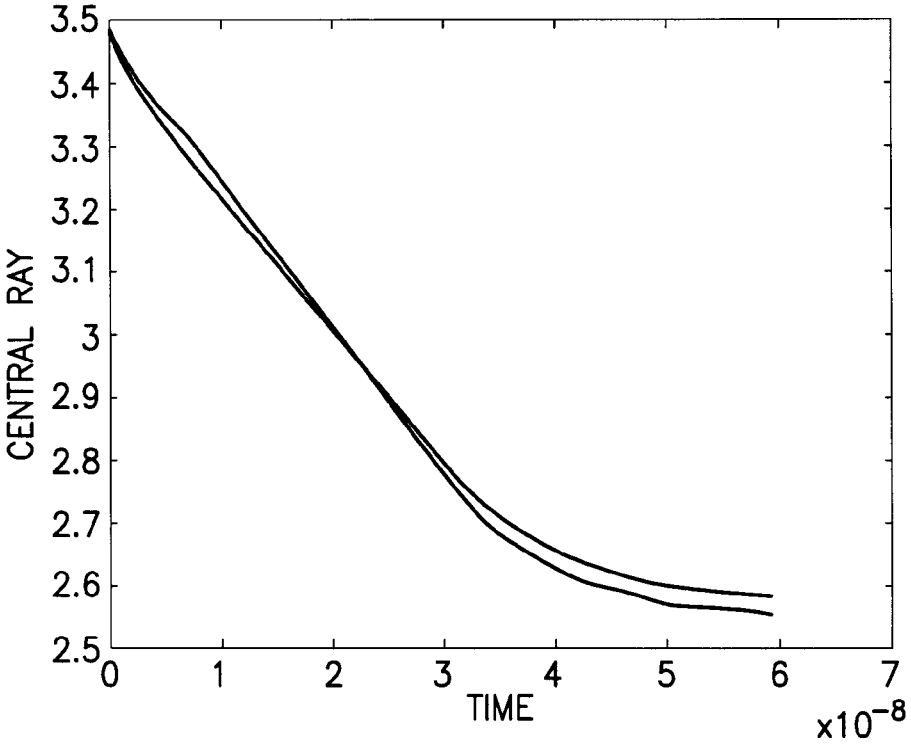
FIG. 7*a* illustrates the contraction of the central ray (the curve with oscillations), where each color represents one complete revolution according to an aspect of the invention.

Reality, of course, is never ideal. FIG. 7*a* follows only electrons injected at time 0 (an arbitrary reference point). In one of the at least one idea scenarios, the scenario of orderly beam stacking depicted above requires that $r_i$ remains at the same location for the duration of the injection window (30 ns or about 6 revolutions). Since $r_i$ is controlled by the relative magnitudes of the injection energy and the magnetic field at the moment of injection, the relationship between the two at time 0 must be preserved for electrons leaving the injector after time 0. In practice, this may not really be the case.

Figure 7B:
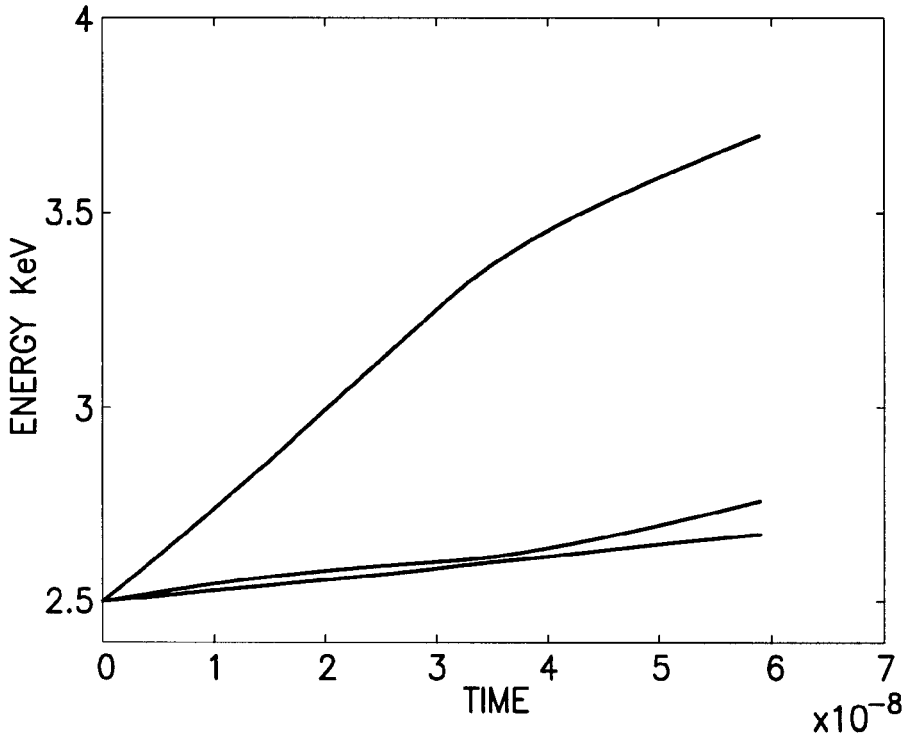
FIG. 7*b* illustrates the injected beam energy (red), matched injection energy (green) and actual injection energy (blue) after time 0 for the injection parameters given in FIG. 7*a*, according to an aspect of the invention.

FIG. 7*b* compares the energy of electrons injected at t=0, the actual injection energy, and the matched injection energy vs. time for the given injection parameters. The difference in the slopes of the injected electron energy (red) during and after the injection window is due to the deceleration force from the contraction voltage. The fact that the actual injection energy at time t (blue) falls below the red curve tells us that the injection voltage slew rate at 3 kV/μs is too slow even without the contraction pulse. With a 120V contraction pulse and to preserve the injection relationship between $r_c$ and $r_i$, the injection energy should follow the green curve, with a slew rate at nearly 26 kV/μs, which is extremely difficult to achieve considering that the injector has a non-negligible intrinsic parasitic capacitance.

Figure 7C:
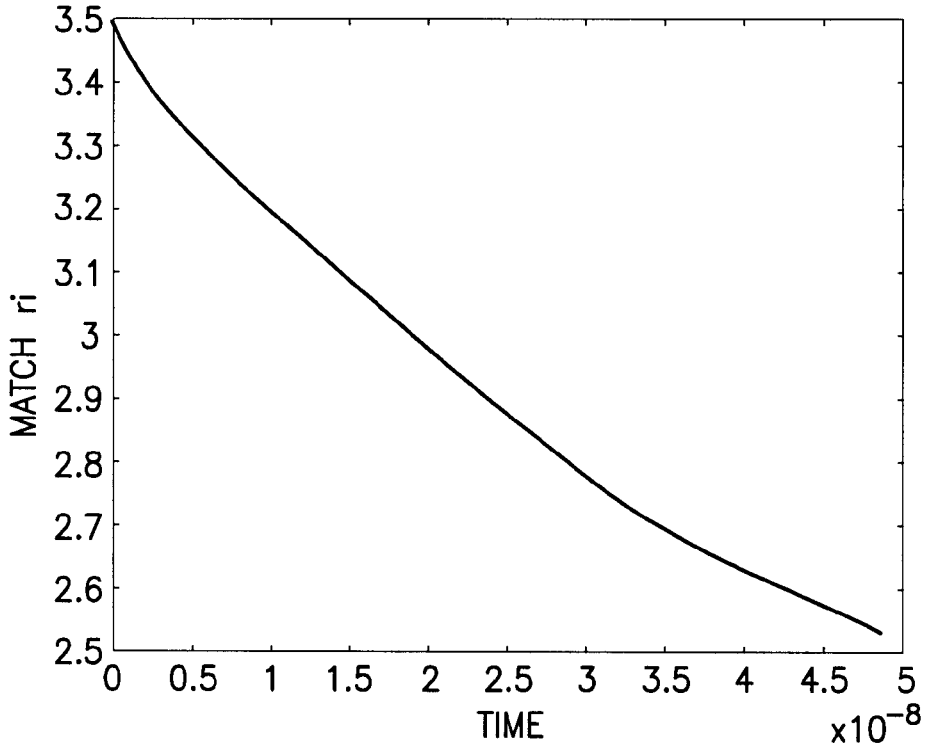
FIG. 7*c* illustrates the expected locations of $r_i$ for the given injection voltage slew rate according to an aspect of the invention.
Figure 7D:
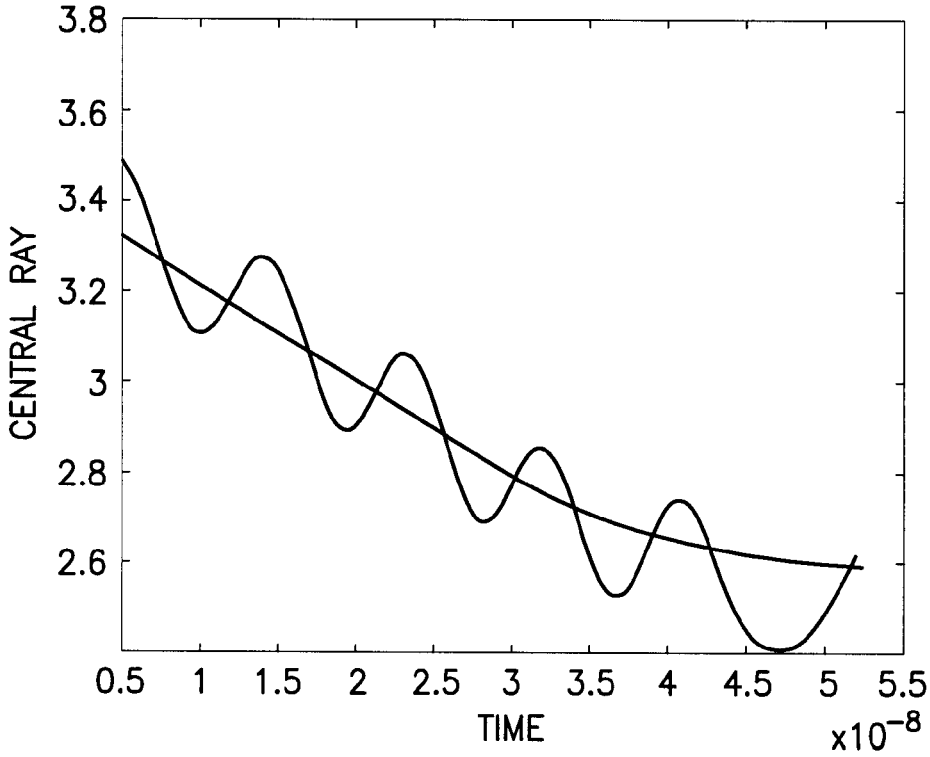
FIG. 7*d* illustrates the contraction of central ray 5 ns after time 0, the injection energy is 2.515 keV and initial $r_i$ is 3.32 cm, such that the contraction time is reduced to 25 ns, and all other parameters remain the same according to an aspect of the invention.

The mismatch between the injection energy and the magnetic field after time 0 means the instantaneous orbit $r_i$ will progressively shift inwards, as shown in FIG. 7*c*. Consequently, betatron oscillation amplitude increases. FIG. 7*d* shows the central ray contraction for electrons injected 5 ns after time zero. Although $r_c$ clears the injector by a wide margin, more than 50% of the beam is lost to the inside wall. For electrons injected later, the loss percentages are even higher. Of course charge may also be trapped before time zero. For those electrons the main loss mechanism is probably collisions with the injector As the acceleration progresses, the oscillation amplitudes damp and instantaneous orbits of surviving electrons move toward the betatron orbit $r_b$ (3 cm in this example). Following injection, higher energy electrons have larger orbits and they will also gain slightly more energy per turn. In other words, in our example here, electrons injected earlier in time have higher energies and their instantaneous orbits will remain on the outside. When the beam is dumped to the target at full energy by orbit expansion, the x-ray profile reflects the charge distribution across the cross section of the trapped beam, or trapping efficiencies at different time within the contraction window. One may observe distinct x-ray peaks and valleys due to overlapping beam envelopes and gaps between adjacent revolutions. Discontinuous beam loss to the injector structure may also create "holes".

Thus, even though the injection window suggests one should be able to trap ~6 turns, we probably trapped only ~ one turn and with a high loss near the tail end. For a dispenser cathode that typically delivers 5 mA injected current or about 35 pC per revolution the total trapped charge is probably no more than 10-20 pC. The amount of trapped charge would probably be less for a CNT (carbon nanotube) cathode of the same emission area that delivers only 2 mA at the present time. One can improve the situation somewhat by reducing the main coil drive modulation frequency. However, since the main culprit here is the contraction pulse, reducing the main drive coil rise time only results in a small gain. One cannot reduce the contraction voltage either since its value is dictated by the requirement that $r_c$ misses the injector in the first revolution.

Radiation is produced at full designed beam energy (1.5 MeV) by directing the beam to impinge on the target. This is done by reversing the orbit contraction mechanism. The voltage applied to the orbit control coil is typically a few hundred volts, and the expansion rate is only on the order of a few μm per revolution. Consequently, the electron beam only grazes the target on the inside edge. Collisions with target electrons result in small angle scatterings, and an incoming high energy electron has an approximate 50% probability of escaping the target. Because of the small acceptance angle of betatron, any electron exiting the target at more than a few degrees will most likely hit the vacuum chamber wall and is lost. MCNP simulations suggest the impact point should be at least 1 mm from the target edge for optimal energy conversion inside the target. In other words, the orbit should expand at a minimum rate of 1000 μm per revolution, which cannot be easily achieved by increasing the voltage applied to the control coil. Another solution is to place the target at a radius where there is a strong radial defocusing force, i.e. outside the outer intersect in FIG. 4. This latter approach, however, isn't compatible with external injection.

Embodiments of the Invention

Figure 8A:
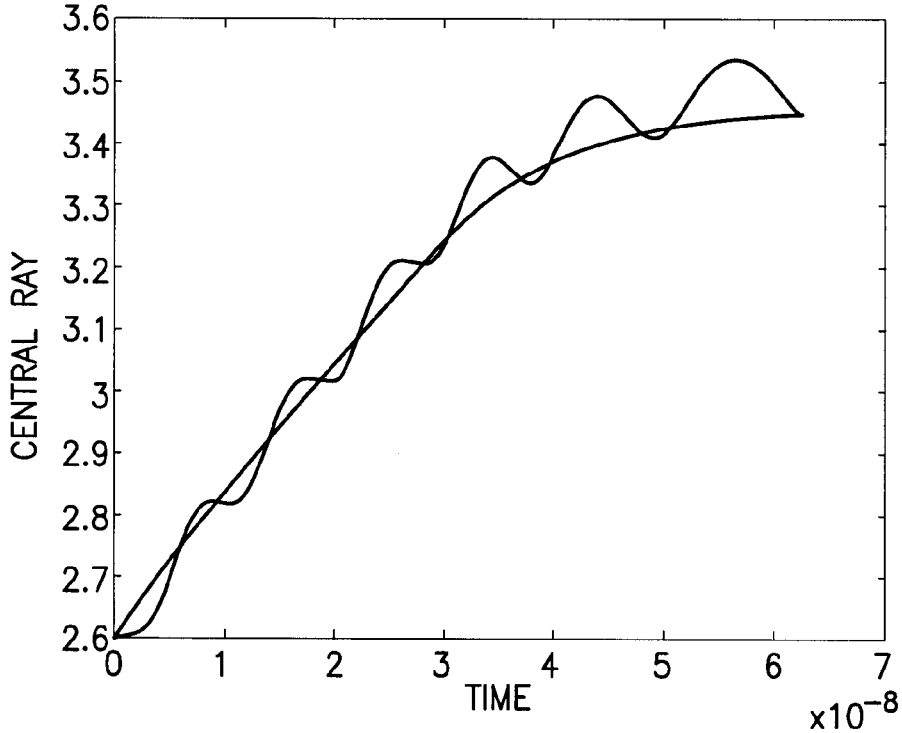
FIG. 8*a* illustrates the internal injection with the relevant parameters are: initial $r_i=r_c=2.6$ cm, betatron orbit $r_b=3.0$, injection energy=2.5 keV, peak acceleration energy=1.5 MeV, main coil modulation frequency=38.8 kHz, injection angle=0.1°, expansion voltage switch off 30 ns after injection (10 ns decay time), expansion capacitor charging voltage=−120V, total charge in aperture=25 pC, injector voltage slew rate=3 kV/μs according to an aspect of the invention.

Instead of injecting electrons from outside the betatron aperture, one can inject electrons from inside the aperture, e.g., internal injection. According to at least one aspect of the invention this can be a more favorable injection configuration than an external injection in terms of orbit dynamics. For example, instead of deceleration, one may apply an acceleration pulse to the orbit control coil to trap electrons, and the magnetic field rise time in the orbital region reduces, rather than increases, during the pulse. As a result, the severity of the mismatch situation is reduced significantly. FIG. 8*a* is the simulation result using the same parameters as in FIG. 7*a* except that both initial $r_i$ and $r_c$ are set at 2.6 cm and the injection angle is 0.1° (essentially tangent). There is some betatron oscillation but that was introduced on purpose (by adjusting the injection angle) in order for $r_c$ to clear the injector after the first revolution. Otherwise I would have to increase the "expansion" pulse voltage.

Figure 8B:
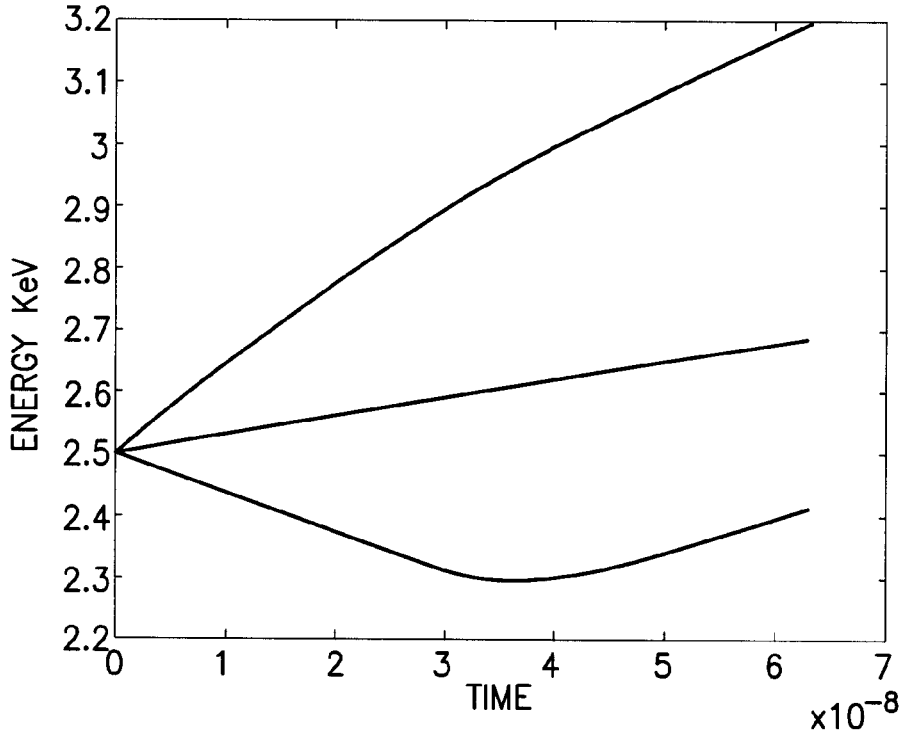
FIG. 8*b* illustrates the injected beam energy (red), matched injection energy (green) and actual injection energy (blue) after time 0 for the injection parameters given in FIG. 8*a*, wherein the matched energy starts to increase after the expansion voltage is turned off at 30 ns (the end of the charge trapping window) due to the rising magnetic field from the main drive coil according to an aspect of the invention.
Figure 8C:
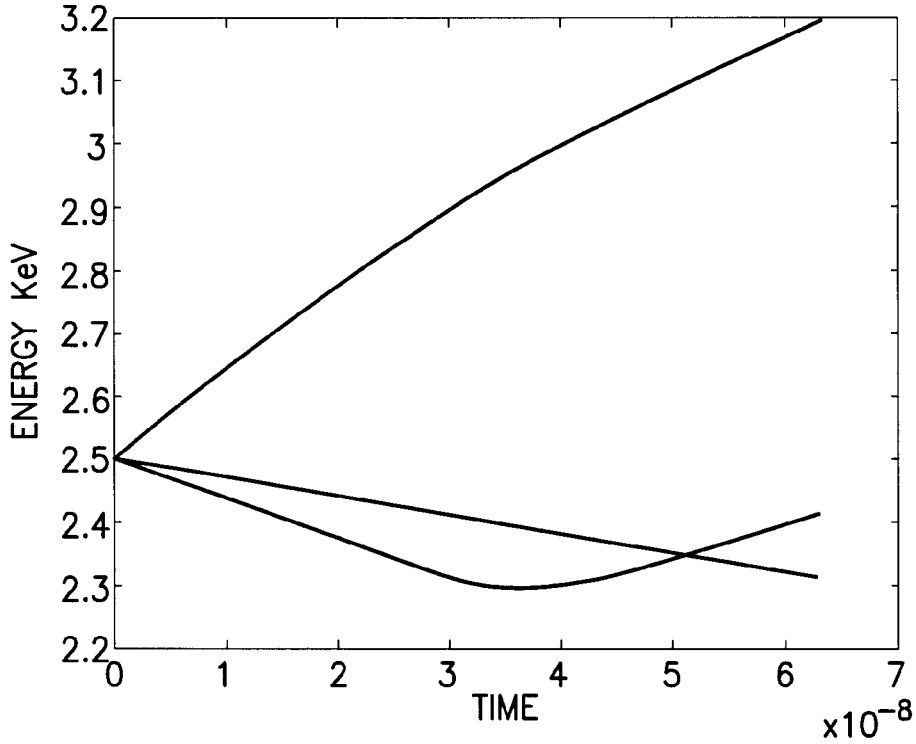
FIG. 8*c* schematically illustrates the same as FIG. 8*b* but with expansion pulse fall off at 3 kV/μs according to an aspect of the invention.
Figure 8D:
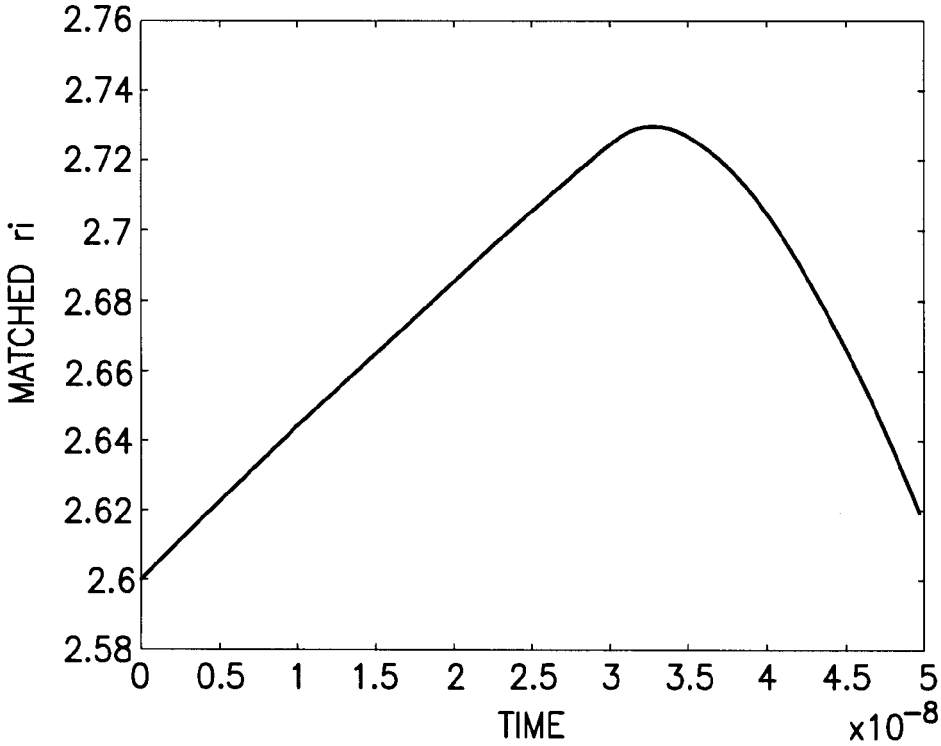
FIG. 8*d* illustrates the matched $r_i$ after time 0 for the parameters in FIG. 8*c* according to an aspect of the invention.
Figure 8E:
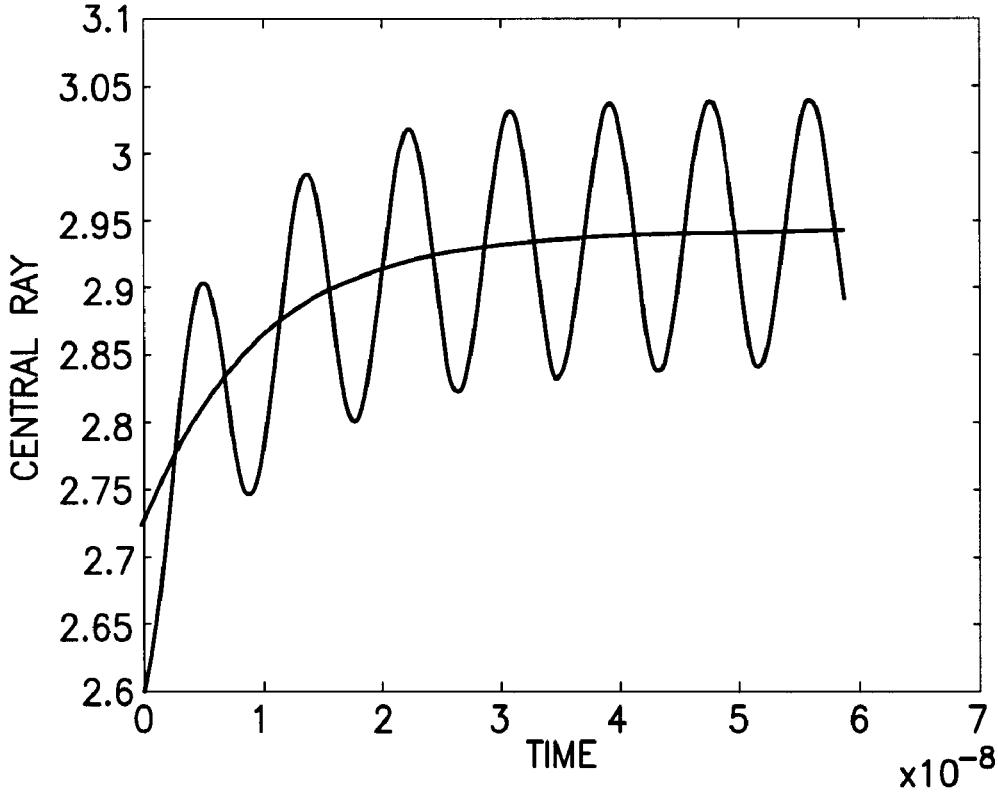
FIG. 8*e* illustrates the expansion of $r_i$ and $r_c$ for electrons injected 30 ns after time 0 according to an aspect of the invention.

The real advantage of internal injection becomes apparent in FIG. 8*b*, which shows a much smaller mismatch between the blue and green curves than external injection. If one places the injection window on the falling edge of the injector pulse the mismatch is even smaller. The results are shown in FIG. 8*c* with the expansion pulse falling off at 3 kV/μs. The corresponding variation of matched $r_i$ is shown in FIG. 8*d*. During the 30 ns window $r_i$ changes by ~1.2 mm vs. 7 mm for external injection. Expansion of $r_i$ and $r_c$ for electrons injected 30 ns after time 0 are given in FIG. 8*e*. Judging from those trajectories it's quite clear that charge trapping occurs with minimum loss for the entire 30 ns expansion time (6 revolutions). In addition, because electrons injected at 30 ns clear the injector by a wide margin (~1.3 mm), trapping will continue for another ~1-2 revolutions as the expansion voltage falls off after 30 ns. This suggests that internal injection will likely lead to a significant leap (×10) in radiation output over that of the external injection scheme in use today.

Since the injector and the target is no longer the same structure, one is now free to locate the target at a radial location where the orbit expansion rate is >1 mm/turn (i.e. at n>1), and at an azimuthal position on the circumference so that majority of γ rays enter the formation at a desirable angle. One can also install multiple injectors and/or targets. Using multiple injectors increases the effective injection current without increasing the space charge forces. However, since every additional injector is also an obstacle the beam must avoid the number of injectors and their locations must be chosen carefully.

Figure 9:
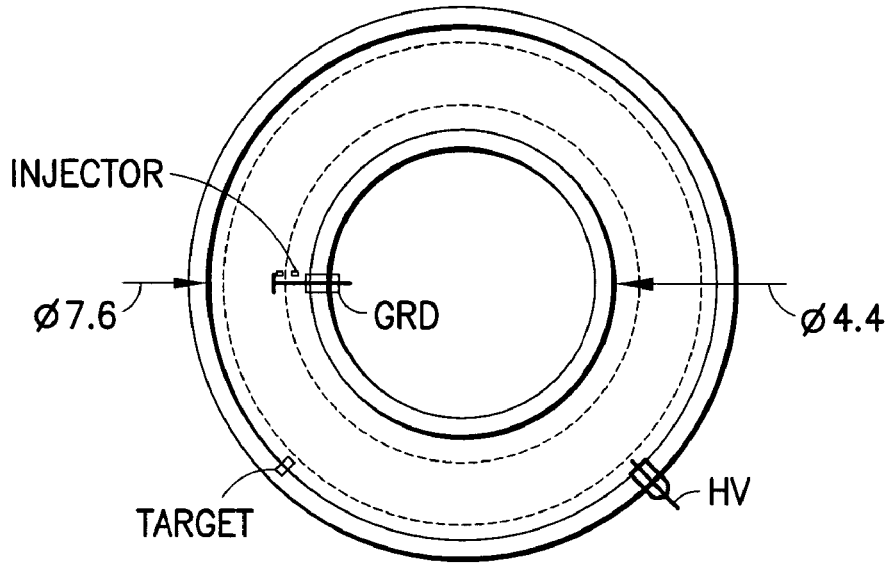
FIG. 9 illustrates the top view of a betatron vacuum donut, the two dashed circles indicate the location of the radial acceptance aperture, the target and the high voltage feedthrough can be the same structure according to an aspect of the invention.

The main difficulties involved are: (1) one has to reduce the size of the injector and (2) feed the high voltage pulse to the injector. FIG. 9 is a top view of a betatron vacuum donut. Also shown are the radial aperture and an injector mounted on the inner radius of the donut. Generally speaking, the size of the injector depends very much on the type of cathode used. For thermionic cathode, i.e. dispenser cathode, the overall injector may be somewhat larger than a field emission cathode because the extra space needed for heating wires and thermal insulation. Another disadvantage of using a dispenser cathode is that an extra electric feedthrough is needed to provide the heating power (albeit at essentially ground potential). The main advantage of a dispenser cathode is that its emission density is still considerably higher than other candidates. An alternative is a cold cathode such as carbon nano tubes field emission cathodes. An injector with a CNT emitter can be made extremely small using semiconductor fabrication technologies. It also doesn't need heating power. However, at the present time its emission density is still a factor of 2-3 below that of the dispenser cathode. Multiple injectors scheme can be of great help here.

The injector is normally powered by a negative high voltage pulse to the cathode. The high voltage pulse must go through the vacuum wall. This is where the main challenge lies due to poor accessibility of an internal injector. The desirable voltage pulse is about 3-7 kV and ≅1 μs in duration. An electric feedthrough with a 7 kV standoff capability is several mm in length. In addition, the high voltage cable also requires insulation. There simply isn't enough space to accommodate the feedthrough and the cable through the inside wall as most of that space is occupied by magnet. A much more elegant solution is to drive the injector with a positive high voltage pulse to the anode and feed the high voltage through the outside wall and connect it to the interior surface. We can do this because the exposed interior surface is coated with a resistive coating (on the order of 100Ω per square) to prevent surface charge buildup. Thus, the inside volume of the vacuum donut is essentially a Faraday's cage, i.e. the entire volume is at the same potential. The positive voltage applied to the anode extracts electrons from the cathode in the same way as a negative voltage applied to the cathode does. Once electrons leave the injector they enter a free space just as in the external injection. The only electric lead that needs to go through the inside wall is the connection to the cathode, which is at ground potential.

For a triode injector, one also needs to provide a grid voltage. This can be accomplished with a voltage divider connecting anode, grid and cathode. The high voltage insulators separating electrodes may also serve as the voltage divider if appropriate bulk resistive ceramics are used. Alternatively the divider may be painted or printed on the insulator surface since its power rating is very low.

For field emission arrays such as CNTs, the emission density at a fixed extraction electric field often drops as the cathode ages. To compensate one must increase the extraction field in order to maintain the same current. A fixed internal voltage divider doesn't have the flexibility of changing the grid voltage relative to those of the anode and cathode. The extraction field is increased by increasing the amplitude of the anode voltage pulse whether the injector is a diode or triode. This in turn leads to higher injection energy and other appropriate parameters such as injection timing, orbit control voltage and timing should be adjusted accordingly. Once the responses of relevant parameters have been mapped out, the adjustment may be done automatically using the detected radiation intensity of a source monitor as a feedback control.

One or more embodiments of the present invention have been described. Nevertheless, it will be understood that various modifications may be made without departing from the spirit and scope of the invention. It is noted that the foregoing examples have been provided merely for the purpose of explanation and are in no way to be construed as limiting of the present invention. While the present invention has been described with reference to an exemplary embodiment, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. A betatron magnet having at least one electron injector positioned approximate an inside of a radius of a betatron orbit, the betatron magnet comprising:

a first guide magnet having a first pole face and a second guide magnet having a second pole face and both the first guide magnet and the second guide magnet having a centrally disposed aperture, wherein the first pole face is separated from the second pole face by a guide magnet gap;

a core disposed within the centrally disposed apertures, in an abutting relationship with both the first guide magnet and the second guide magnet, the core having at least one core gap;

a drive coil wound around the first pole face and the second pole face;

an orbit control coil having a core portion wound around the at least one core gap and a field portion wound around both the first pole face and the second pole face, the core portion and the field portion are connected in series but in opposite polarity;

wherein magnet fluxes in the core and the first and the second guide magnets return through one or more peripheral portions of the betatron magnet;

a circuit effective to provide voltage pulses to the drive coil and to the orbit control coil; and an electron acceleration passageway located within the guide magnet gap such that electrons are injected into the betatron orbit with the at least one electron injector positioned approximate the inside of the radius of the betatron orbit within the electron acceleration passageway.

2. The betatron of claim 1, wherein the core is a hybrid having a high saturation flux density central portion and a perimeter formed from a fast response highly permeable magnetic material.

3. The betatron of claim 2, wherein the central portion is an amorphous metal and the perimeter is a ferrite with a magnetic permeability in excess of 100.

4. The betatron of claim 2, wherein a cumulative width of the at least one core gap is effective to satisfy a betatron condition.

5. The betatron of claim 4, wherein the cumulative width of the at least one core gap is between 2 millimeters and 2.5 millimeters.

6. The betatron of claim 4, wherein the at least one core gap is formed of multiple gaps.

7. The betatron of claim 4, wherein diameters of both the first pole face and the second pole face are between 2.75 inch and 3.75 inch.

8. The betatron of claim 4, wherein a turn ratio of the core portion windings to the field portion windings is 2:1.

9. The betatron of claim 8, wherein a turn ratio of the drive coil windings to the field portion windings is at least 10:1 and the number of drive coil windings is at least 10.

10. The betatron of claim 9, wherein the circuit provides a nominal peak current of 170 A and a nominal peak voltage of 900V.

11. The betatron of claim 1, wherein the betatron magnet is affixed to a sonde effective for insertion into an oil well bore hole.

12. A method to generate x-rays, the method comprising the steps of:

providing a betatron magnet that includes a first guide magnet having a first pole face and a second guide magnet having a second pole face and both the first guide magnet and the second guide magnet having a centrally disposed aperture, wherein the first pole face is separated from the second pole face by a guide magnet gap and a core disposed within the centrally disposed apertures, in an abutting relationship with both the first guide magnet and the second guide magnet, the core having at least one core gap;

circumscribing the guide magnet gap with an electron passageway;

a drive coil wound around the first pole face and the second pole face forming a first magnetic flux of a first polarity to an opposing second polarity and that passes through central portions of the betatron magnet and the core as well as through the electron passageway and then returns through peripheral portions of the betatron magnet;

injecting electrons into an betatron orbit within the electron passageway when the first magnetic flux is at approximately a minimum strength at the first polarity, such that the electrons are injected with at least one electron injector positioned approximate along an inside of a radius of the betatron orbit;

forming a second magnetic flux at the opposing second polarity that passes through the electron passageway and the first polarity through a perimeter of the core and returns through the electron passageway in the opposing second polarity for a first time effective to expand the injected electron orbits to an optimal betatron orbit, wherein after the first time the perimeter of the core magnetically saturates and the second magnetic flux passes through an interior portion of the core and in combination with the first magnetic flux, accelerates the electrons whereby enforcing a flux forcing condition; and applying the second magnetic flux when the first magnetic flux approached a maximum strength thereby expanding the electron orbit causing the electrons to impact a target causing an emission of x-rays.

13. The method of claim 12, wherein the second magnetic flux is formed by energizing a core portion of a orbit control coil wound around the at least one core gap.

14. The method of claim 13, wherein a return portion of the second magnetic flux in the peripheral portions of the betatron magnet is cancelled by a flux generated by a field portion of the orbit control coil wound around both the first pole face and the second pole face.

15. The method of claim 14, wherein the field portion is electrically connected in series, but at opposite polarity, to the core portion.

16. The method of claim 15, wherein a turn ratio of field portion to the core portion is effective to cause the second flux to return through the electron passageway.

17. The method of claim 12, wherein shorting the orbit control coil is effective to enforce the flux forcing condition.

18. The method of claim 16, wherein a turn ratio of core portion windings to field portion windings is 2:1.

19. The method of claim 16, wherein the core is formed as a hybrid having a high saturation flux density interior and a fast response permeable perimeter.

20. The method of claim 19, wherein the first time is on the order of 100 nanoseconds.

21. The method of claim 20, wherein a time from minimum strength at the first polarity to maximum strength at the first polarity is on the order of 30 microseconds.

22. The method of claim 16, wherein the first magnetic flux and the second magnetic flux are effective to accelerate the electrons to in excess of 1 MeV.

23. The method of claim 16, wherein a turn ratio of the drive coil windings to the field portion windings is 10:1.

24. The method of claim 23, wherein the drive coil is driven by a modulating circuit that provides a cycling voltage with a nominal peak current of 170 A and nominal peak voltage of 900V.

25. The method of claim 24, wherein the voltage cycles at a nominal rate of 2 kHz.

26. The method of claim 25, wherein the orbit control coil is pulsed to 120-150 volts during electron orbit expansion or contraction and shorted during electron acceleration.

27. The method of claim 12, wherein the x-rays are directed at subsurface formation formations access via an oil well bore hole.

28. A betatron magnet having at least one electron injector positioned approximate an inside of a radius of a betatron orbit along with using at least one separated target placed approximate an outer edge of the betatron magnet, the betatron magnet comprising:

a first guide magnet having a first pole face and a second guide magnet having a second pole face and both the first guide magnet and the second guide magnet having a centrally disposed aperture, wherein the first pole face is separated from the second pole face by a guide magnet gap;

a core disposed within the centrally disposed apertures, in an abutting relationship with both the first guide magnet and the second guide magnet, the core having at least one core gap;

a drive coil wound around the first pole face and the second pole face;

an orbit control coil having a core portion wound around the at least one core gap and a field portion wound around both the first pole face and the second pole face, the core portion and the field portion are connected in series but in opposite polarity;

wherein the first magnetic fluxes in the core and the first and the second guide magnets return through one or more peripheral portions of the betatron magnet;

a circuit effective to provide voltage pulses to the drive coil and to the orbit control coil; and an electron acceleration passageway located within the guide magnet gap, such that electrons are injected with the at least one electron injector positioned approximate the inside of the radius of the betatron orbit along with using the at least one separated target placed approximate the outer edge of the betatron magnet.

29. The betatron of claim 28, wherein the at least one electron injector provides for a lead at least ten times a radiation output over that of an external injection betatron magnet scheme.

30. A betatron magnet, the betatron magnet comprising:

at least one electron injector positioned approximate an inside of a radius of an betatron orbit such that electrons are injected into the betatron orbit with the at least one electron injector positioned within an electron acceleration passageway; and wherein the at least one electron injector is driven with a positive high voltage pulse to an anode, such that a circuit feeds the positive high voltage pulse to the anode through an outside wall of an evacuated chamber containing the electron acceleration passageway and through a resistive coating on an interior surface of the evacuated chamber, the positive high voltage pulse applied to the anode extracts electrons from a cathode, whereby after electrons leave the at least one electron injector the electrons enter a free space of equal-potential contained within at least a portion of surfaces of the resistive coating of the evacuated chamber, such that at least one electric lead enters through an inside wall of the evacuated chamber and is in connection to the cathode, which is at ground potential.

31. A method of driving at least one electron injector for an internal injection scheme of a betatron magnet, the method comprising:

injecting electrons into an betatron orbit with the at least one electron injector positioned within an electron acceleration passageway, wherein the at least one electron injector positioned approximate an inside of a radius of an betatron orbit; and driving the at least one electron injector with a positive high voltage pulse to an anode, such that a circuit feeds the positive high voltage pulse to the anode through an outside wall of an evacuated chamber containing the electron acceleration passageway and through a resistive coating on an interior surface of the evacuated chamber, applying the positive high voltage pulse to the anode so as to extract electrons from a cathode, whereby after electrons leave the at least one electron injector, the electrons enter a free space of equal-potential contained within at least a portion of surfaces of the resistive coating of the evacuated chamber, such that at least one electric lead enters through an inside wall of the evacuated chamber and is in connection to the cathode, which is at ground potential.

* * * * *